US009464372B2

(12) United States Patent
Ueda et al.

(10) Patent No.: US 9,464,372 B2
(45) Date of Patent: Oct. 11, 2016

(54) SEWING MACHINE

(71) Applicant: BROTHER KOGYO KABUSHIKI KAISHA, Nagoya-shi, Aichi-ken (JP)

(72) Inventors: Daisuke Ueda, Owariasahi (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/636,525

(22) Filed: Mar. 3, 2015

(65) Prior Publication Data

US 2015/0252504 A1 Sep. 10, 2015

(30) Foreign Application Priority Data

Mar. 6, 2014 (JP) ..... 2014-043871

(51) Int. Cl.

| | |
|---|---|
| ***D05B 37/04*** | (2006.01) |
| ***B26F 1/02*** | (2006.01) |
| ***D06H 7/00*** | (2006.01) |
| ***D05B 37/06*** | (2006.01) |
| ***D05C 7/04*** | (2006.01) |
| *D06C 7/04* | (2006.01) |

(52) U.S. Cl.

CPC ..... *D05B 37/04* (2013.01); *B26F 1/02* (2013.01); *D05B 37/063* (2013.01); *D05B 37/066* (2013.01); *D05C 7/04* (2013.01); *D06H 7/00* (2013.01); *D05D 2305/08* (2013.01)

(58) Field of Classification Search

CPC ..... D05B 37/00; D05B 37/04; D05B 37/02; D05B 37/06; D05B 37/063; D05B 37/066; D05C 7/00; D05C 7/02; D05C 7/04; D05C 13/00; D05C 3/02; B26F 1/02; B26F 1/38; B26F 1/382; D06H 7/00; D06H 7/16; D05D 2305/08

See application file for complete search history.

(56) References Cited

U.S. PATENT DOCUMENTS

| | | | | | |
|---|---|---|---|---|---|
| 3,211,115 | A * | 10/1965 | Burillon | D05B 81/00 | 112/122 |
| 3,857,346 | A * | 12/1974 | Dal Negro | D05B 23/00 | 112/130 |
| 3,938,454 | A * | 2/1976 | Boser | D05B 37/04 | 112/130 |
| 4,271,768 | A * | 6/1981 | Goldbeck | D05B 37/02 | 112/68 |
| 4,384,540 | A * | 5/1983 | Vollmar | D05B 37/06 | 112/122.1 |
| 2005/0126459 | A1 * | 6/2005 | Ebata | D05B 37/063 | 112/122 |
| 2006/0005753 | A1 | 1/2006 | Fujihara | | |
| 2011/0203505 | A1 | 8/2011 | Nagai et al. | | |

FOREIGN PATENT DOCUMENTS

| | | |
|---|---|---|
| JP | 2005-124780 A | 5/2005 |
| JP | 2006-020761 A | 1/2006 |
| JP | 2011-172801 A | 9/2011 |

* cited by examiner

*Primary Examiner* — Ismael Izaguirre
(74) *Attorney, Agent, or Firm* — Oliff PLC

(57) ABSTRACT

A sewing machine includes a sewing machine head, a sewing machine bed, a catching member, a cutwork device including a cutting needle having a blade, a cutting needle up-down movement mechanism moving the cutting needle up and down, and a switching mechanism configured to switch the catching member between a working position where the catching member is disposed at the cutting position at the side of the upper surface of the workpiece cloth and a retreat position retreated upward from the working position. The cutwork device is configured to form a cut in the workpiece cloth by the cutting needle at a cutting position from below the workpiece cloth. The switching mechanism is configured to switch a position of the catching member by the movement of the presser bar by the presser mechanism.

5 Claims, 16 Drawing Sheets

SEWING MACHINE

CROSS-REFERENCE TO RELATED APPLICATIONS

This application is based upon and claims the benefit of priority from the prior Japanese Patent Application No. 2014-043871 filed on Mar. 6, 2014, the entire contents of which are incorporated herein by reference.

BACKGROUND

1. Technical Field

The present disclosure relates to a sewing machine in which a needle bar to which a sewing needle is attached is mounted on a sewing machine head, the sewing machine performing sewing on a workpiece cloth placed on a sewing machine bed.

2. Related Art

Sewing machines have conventionally been provided which can cut a workpiece cloth. In these sewing machines, a sewing needle attached to a needle bar is detached and a cutting needle and a cloth-pressing spring are attached to the needle bar. This allows the needle bar to be moved up and down so that the cutting needle forms cuts in the workpiece cloth, with the result that the workpiece cloth can be cut.

SUMMARY

The user needs to replace the sewing needle with the cutting needle and vice versa every time of switching between a sewing work by the use of the sewing needle and a cutting work by the use of the cutting needle in the above-described sewing machines. The replacement of the needles is troublesome. In view of the troublesomeness, the inventors conceived of providing on a sewing machine a device dedicated to cutting the workpiece cloth by the use of a cutting needle without replacement of the sewing needle attached to the needle bar (hereinafter referred to as "a cutwork device"). In this case, a sewing machine head is increased in size when the cutwork device is mounted on the sewing machine head. An increase in the size of the sewing machine head is not preferable. Accordingly, it is desirable to provide the cutwork device on a sewing machine bed. When the cutwork device is provided on the sewing machine bed, cuts are formed by moving the cutting needle upward from below the workpiece cloth. In this case, a distal end of the cutting needle pushes the workpiece cloth upward. More specifically, when the workpiece cloth floats, it is expected that cuts cannot reliably be formed in the workpiece cloth.

Therefore, an object of the disclosure is to provide a sewing machine which can desirably cut the workpiece cloth with the floating of the workpiece cloth being suppressed when the workpiece cloth is cut by the cutwork device provided on the sewing machine bed.

The disclosure provides a sewing machine including a sewing machine head, a presser bar, a presser mechanism, a sewing machine bed, a cutwork device, a catching member and a switching mechanism. The sewing machine head includes a needle bar to which a sewing needle is attachable. The presser bar is located on the sewing machine head and has a lower end to which a presser foot configured to press a workpiece cloth is attachable. The presser mechanism is located in the sewing machine head and configured to move the presser bar between a raised position and a lowered position. The sewing machine bed has an upper surface on which a workpiece cloth is placed so that sewing machine bed. The cutwork device includes a cutting needle with a distal end having a blade and a cutting needle up-down movement mechanism moving the cutting needle up and down. The cutwork device is configured to form a cut in the workpiece cloth by the cutting needle at a cutting position from below the workpiece cloth. The cutting position is spaced a predetermined distance rearward from a needle location of the sewing needle on the sewing machine bed. The catching member is configured to suppress upward floating of the workpiece cloth caused by the cutting needle during operation of the cutwork device. The switching mechanism is configured to switch the catching member between a working position where the catching member is disposed at the cutting position at the side of the upper surface of the workpiece cloth and a retreat position retreated upward from the working position, thereby switching a position of the catching member by the movement of the presser bar by the presser mechanism.

DETAILED DESCRIPTION

Figure 1:
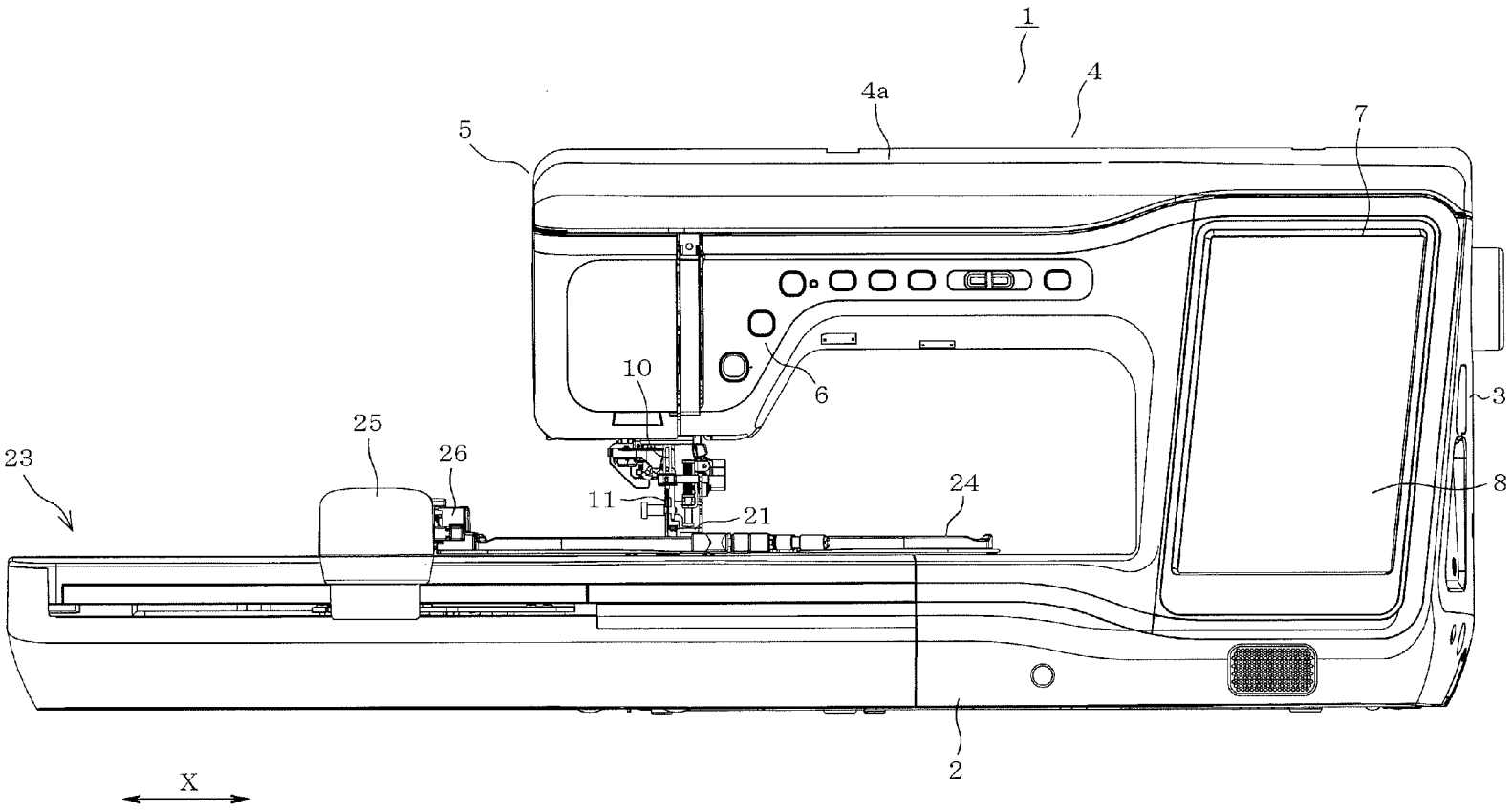
FIG. 1 is a front view of a sewing machine according to one embodiment with an embroidering machine being attached to the sewing machine.

An embodiment will be described with reference to the drawings. The embodiment is applied to a household sewing machine which is capable of sewing an embroidery pattern. Referring to FIG. 1, an overall sewing machine 1 is shown to which an embroidering machine 23 which will be described later is attached. The sewing machine 1 includes a sewing machine bed 2 extending in a right-left direction (X direction). A pillar 3 extends upward from a right end of the sewing machine bed 2. An arm 4 extends leftward from an upper end of the pillar 3 as viewed in FIG. 1. The arm 4 has a distal end serving as a sewing machine head 5. The sewing machine bed 2 and the sewing machine head 5 will be abbreviated as "bed" and "head" in the following description respectively. In the following description, the side where a user is located relative to the sewing machine 1 will be referred to as "front" of the sewing machine. The side located opposite the front will be referred to as "rear." The side where the pillar 3 is located in the sewing machine 1 will be referred to as "right" and the side located opposite the right will be referred to as "left." The bed 2 is to include the embroidery machine 23 in the embodiment.

The arm 4 includes an upper part which is provided with a thread spool housing part to house a thread spool although the thread spool is not shown. The thread spool housing part is covered with a cover 4*a* so as to be openable and closable. The arm 4 includes a front side provided with a plurality of key switches 6. The key switches include a start/stop key instructing start and stop of a sewing work, a backstitching key, a needle up-down key, a thread cutting key, a presser foot up-down key and a speed adjusting knob although these keys and knob will not be described in detail. The pillar 3 includes a front provided with a large-sized vertically long liquid crystal display 7 capable of full color display. A touch panel 8 (see FIG. 16) is mounted on a surface of the display 7.

The display 7 displays a large number of stitch patterns such as ordinary patterns and embroidery patterns, names of functions representing various functions performed in a sewing work and a cutting work which will be described later, various messages and pieces of information. The user can operate the touch panel to select a desirable stitch pattern although the stitch patterns, the function names, the messages and the information are not shown. The user can also operate the touch panel 8 to instruct execution of a cutting operation on a workpiece cloth by a cutwork device which will be described later.

Figure 6:
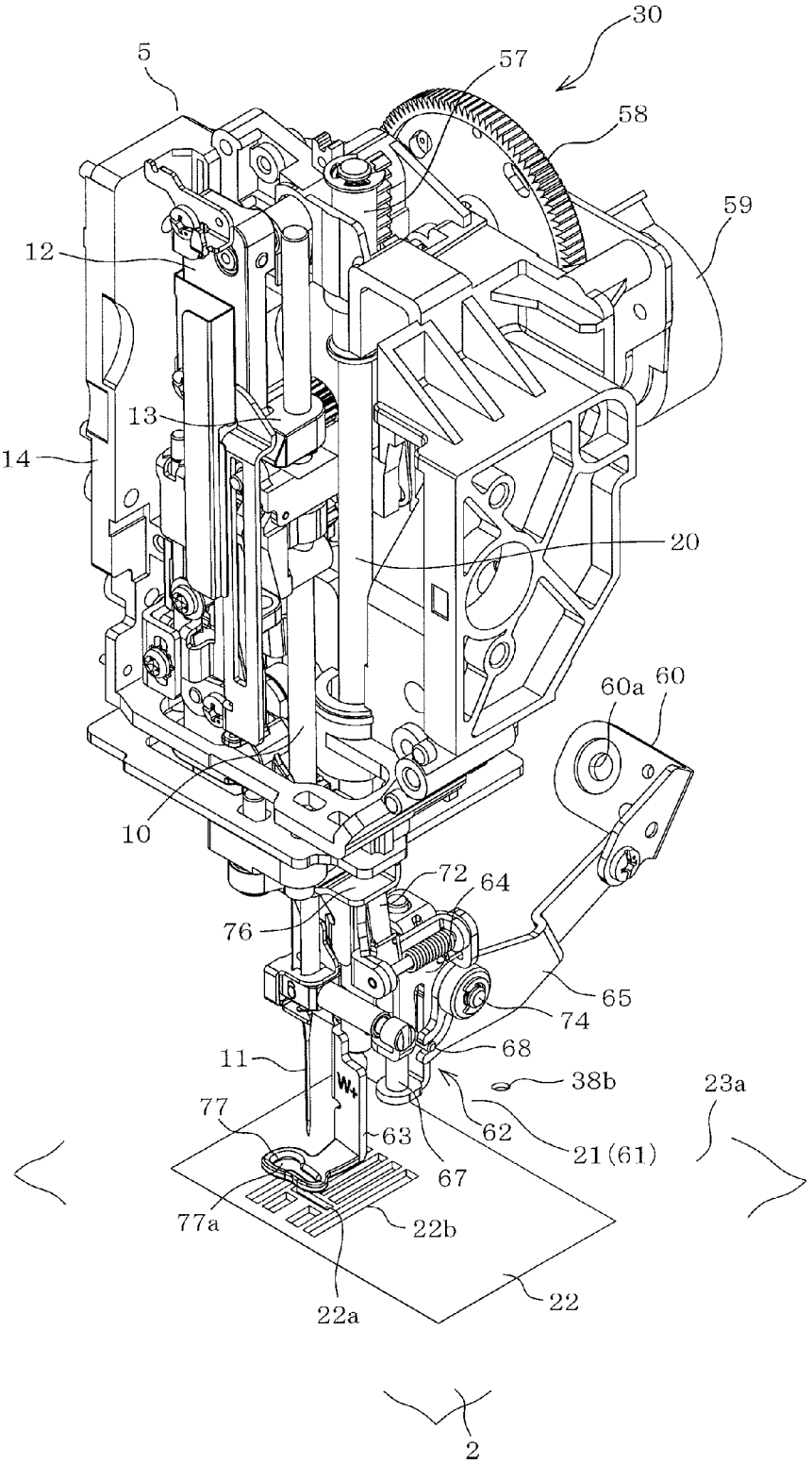
FIG. 6 is a perspective view of a sewing machine head in the case where a receiving member is located at a retreat position, showing an inner structure thereof.
Figure 14:
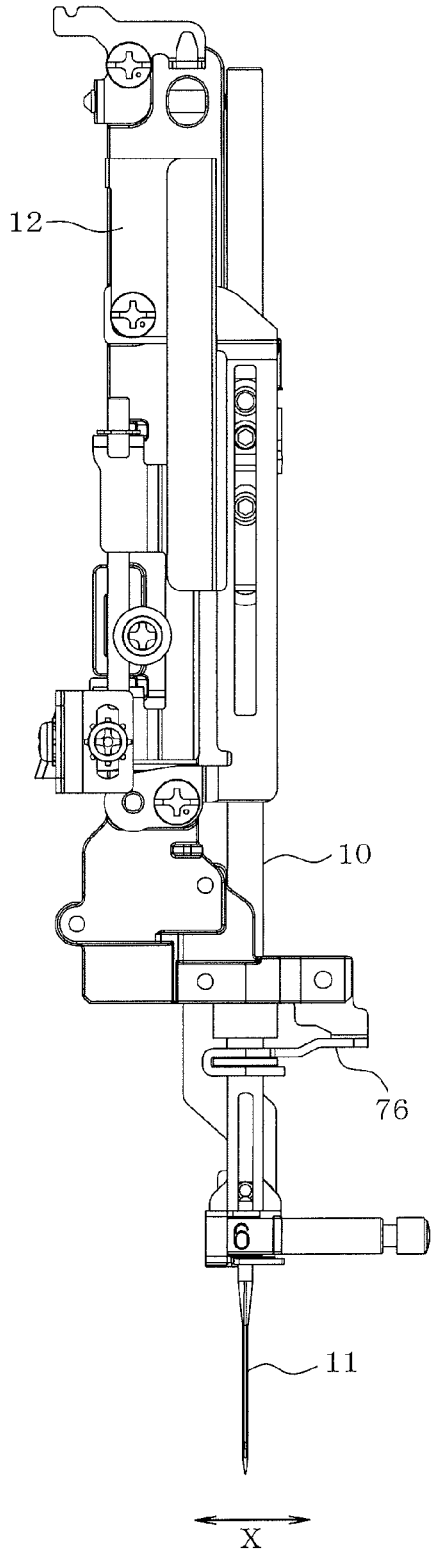
FIG. 14 is a front view of a needle bar base and a needle bar.
Figure 15C:
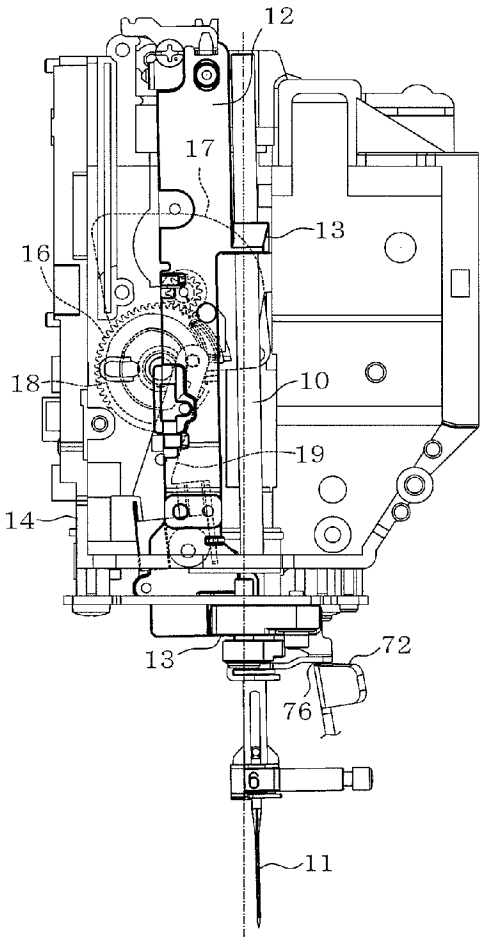
FIGS. 15A, 15B and 15C are front views of a swinging mechanism, showing the state where the needle bar is located at a middle baseline position, the state where the needle bar is located at a left baseline position and the state where the needle bar is located at a right baseline position, respectively.
Figure 15B:
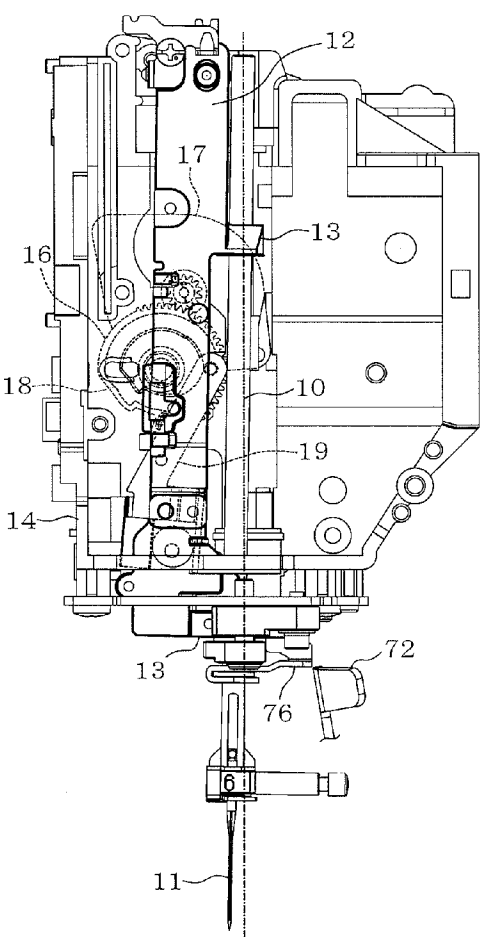
Figure 15A:
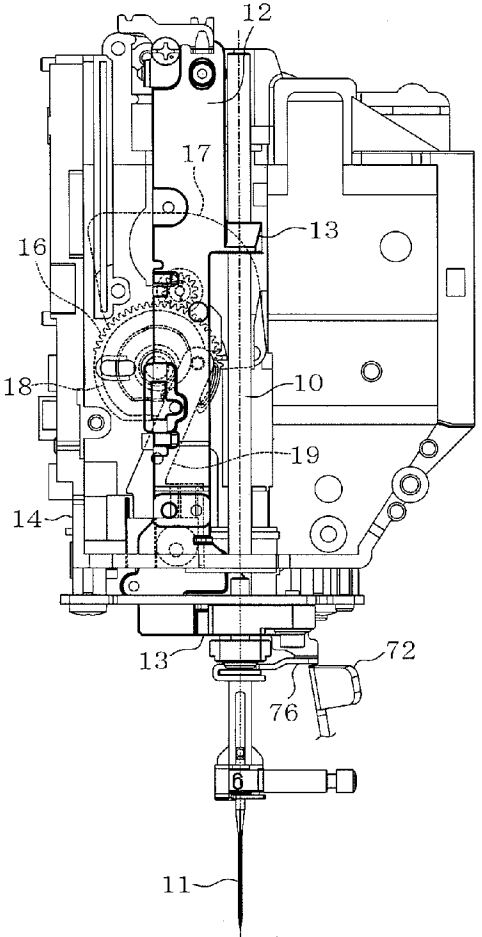

A main shaft (not shown) rotated by a sewing machine motor 9 (see FIG. 16) is provided in the arm 4. A needle bar 10 is mounted on a lower part of the head 5 as shown in FIG. 6 and the like. A sewing needle 11 is detachably attached to a lower end of the needle bar 10. A center line of the sewing needle 11 corresponds with a center line of the needle bar 10 when the sewing needle 11 is attached to the needle bar 10. A vertically long needle bar base 12 is mounted on the head 5 as shown in FIGS. 14 and 15A to 15C. The needle bar base 12 is provided with two, upper and lower, support portions 13 as shown in FIGS. 15A to 15C. The needle bar 10 is supported by the support portions 13 so as to be movable up and down. The needle bar base 12 has an upper end pivotally mounted on a machine frame 14 located in the head 5. The needle bar base 12 is swingable in a right-left direction (the X direction).

A needle bar up-down movement mechanism having a well-known construction is provided in the head 5 although not shown nor described in detail. The needle bar up-down movement mechanism moves the needle bar 10 up and down by rotation of the main shaft. A swinging mechanism 16 is provided in the sewing machine head 5 to swing the needle bar base 12 in the right-left direction (the X direction) as shown in FIGS. 15A to 15C. Upon swing of the needle bar base 12 in the right-left direction, the needle bar 10 is also swung in the right-left direction. The swinging mechanism 16 includes a needle swing motor 17, a swing cam 18 rotated by the needle swing motor 17 and a swing lever 19 driven by the swing cam 18 as well known in the art. The following will describe the needle bar 12 as swung by the swinging mechanism 16, for the sake of simplification in the description.

The needle bar 10 is thus swingable by the swinging mechanism 16 within a predetermined swing range in the right-left direction (the X direction), as shown in FIGS. 15A to 15C. The swinging mechanism 16 is also capable of holding the needle bar 10 at a predetermined position within the swing range as well as swinging the needle bar 10. The predetermined position may include a central baseline position as shown in FIG. 15A, a left baseline position as shown in FIG. 15B and a right baseline position as shown in FIG. 15C. When the needle bar 10 is located at the central baseline position (FIG. 15A), a needle location of the sewing needle 11 is in a central part of the swing range. When the needle bar 10 is located at the left baseline position (FIG. 15B), the needle location of the sewing needle 11 is in a left end of the swing range. When the needle bar 10 is located at the right baseline position (FIG. 15C), the needle location of the sewing needle 11 is in a right end of the swing range. The needle location refers to a point on the workpiece cloth, which the sewing needle 11 penetrates. A first position refers to a position of the needle bar base 12 in the case where the needle bar 10 is located at the central or right baseline position. A second position refers to a position of the needle bar base 12 in the case where the needle bar 10 is located at the left baseline position. When an embroidery sewing is performed as will be described later, the needle bar base 12 is set at the second position, that is, the needle bar base 12 is set so that the needle bar 10 is located at the left baseline position.

Figure 8:
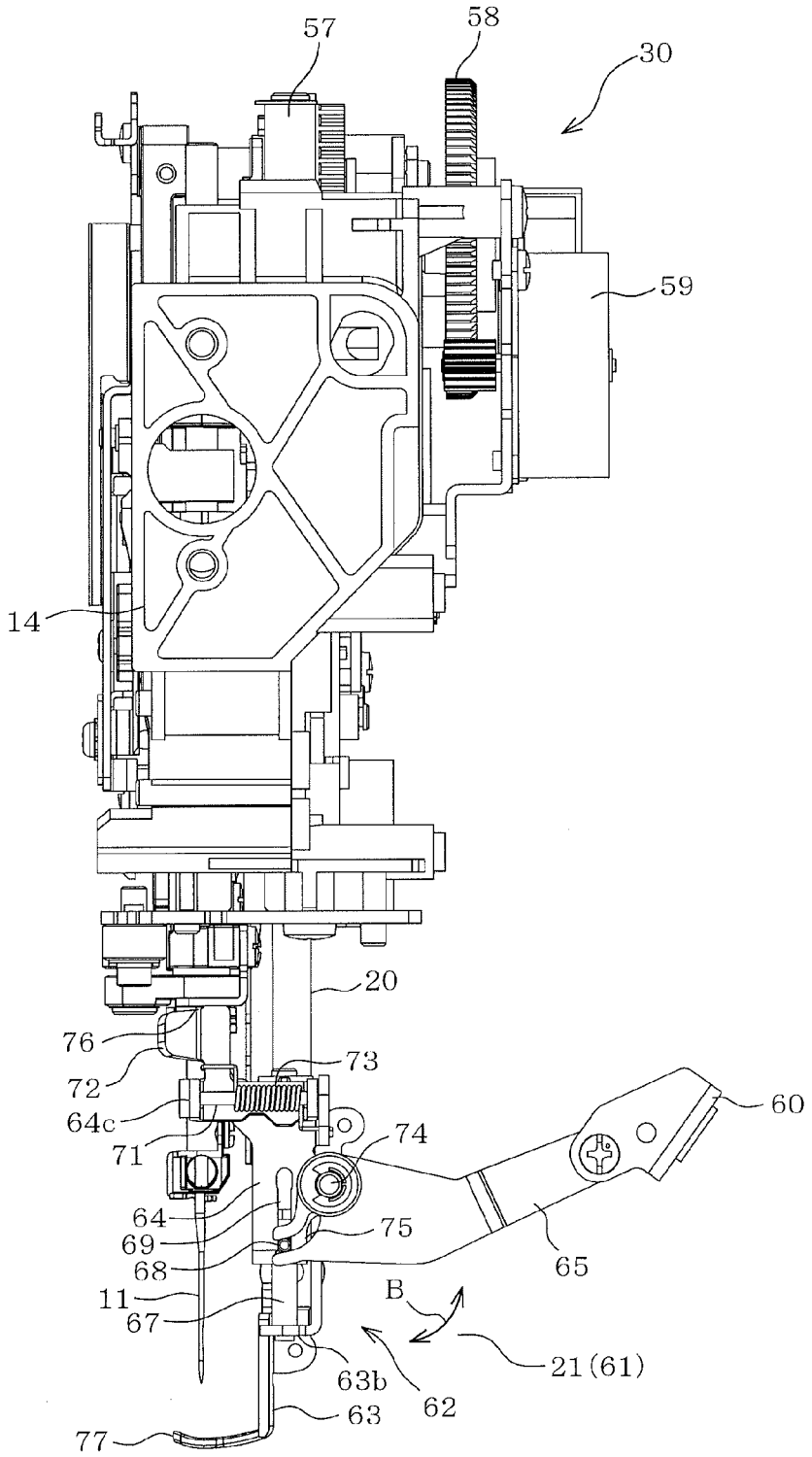
FIG. 8 is a right side view of the sewing machine head in the case where the receiving member is located at the retreat position, showing an inner structure thereof.

A presser bar 20 is mounted on the head 5 so as to be located behind the needle bar 10 and so as to extend in the up-down direction, as shown in FIGS. 6 and 8. A presser foot 21 provided for pressing the workpiece cloth is attached to a lower end of the presser bar 20 to be detachable, that is, to be replaceable. The presser bar 20 is movable between a lowered position and a raised position by a presser mechanism 30. When the presser bar 20 is located at the lowered position, the workpiece cloth is pressed by the presser foot 21. The raised position is retreated upward from the lowered position (spaced from the workpiece cloth).

The presser mechanism 30 may have the same construction as disclosed by Japanese Patent Application Publication No. JP-A-2011-172801, which is incorporated herein by reference. The presser mechanism 30 includes a rack member 57 mounted on an upper end of the presser bar 20, an intermediate gear 58 brought into mesh engagement with the rack member 57 and a presser motor 59 driving the intermediate gear 58. The rack member 57 is moved upward when the presser motor 59 is driven to rotate the intermediate gear 58 clockwise. The rack member 57 is moved downward when the presser motor 59 is driven to rotate the intermediate gear 58 counterclockwise.

The presser bar 20 is moved between the raised position and the lowered position with the upward or downward movement of the rack member 57. The presser motor 59 is driven when the user operates a presser foot up-down key provided on the arm 4. Alternatively, the presser motor 59 is driven based on cutting data which will be described later. The presser mechanism 30 also includes a presser lift lever (not shown) which is manually operated by the user. The presser bar 20, namely, the presser foot 21 are moved up and down when the user moves the presser lift lever up and down.

The presser foot 21 attached to the sewing machine 1 is used for the embroidery sewing. Various types of presser feet (not shown) are prepared other than the presser foot 21, and the presser foot 21 may be replaced with each one of these presser feet if necessary. The presser foot 21 employed in the embodiment includes a catching member as will be described in detail later. The presser foot 21 is thus formed into an embroidery presser unit 61.

Figure 9:
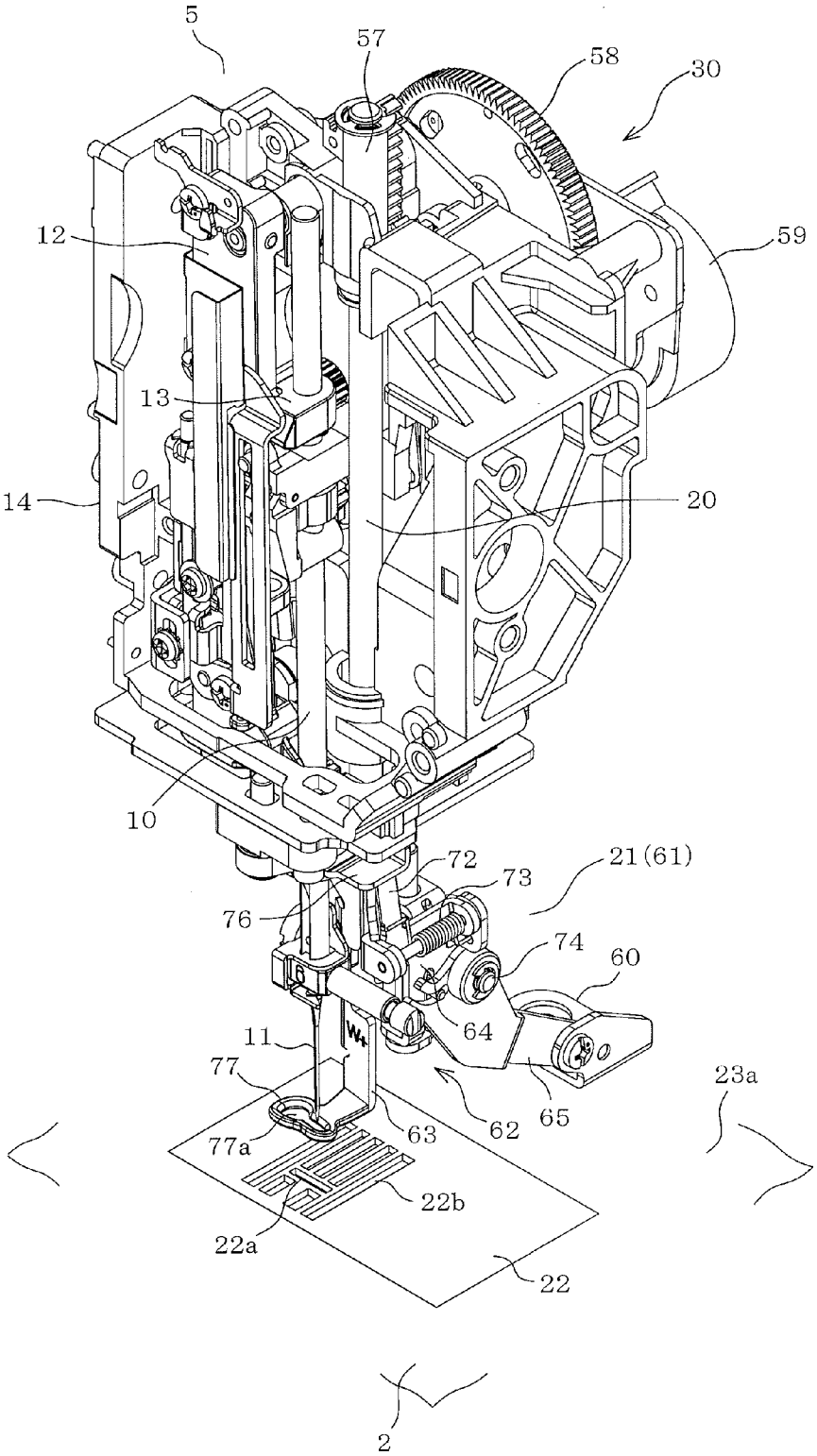
FIG. 9 is a perspective view of the sewing machine head in the case where the receiving member is located at a working position, showing the inner structure thereof.
Figure 10:
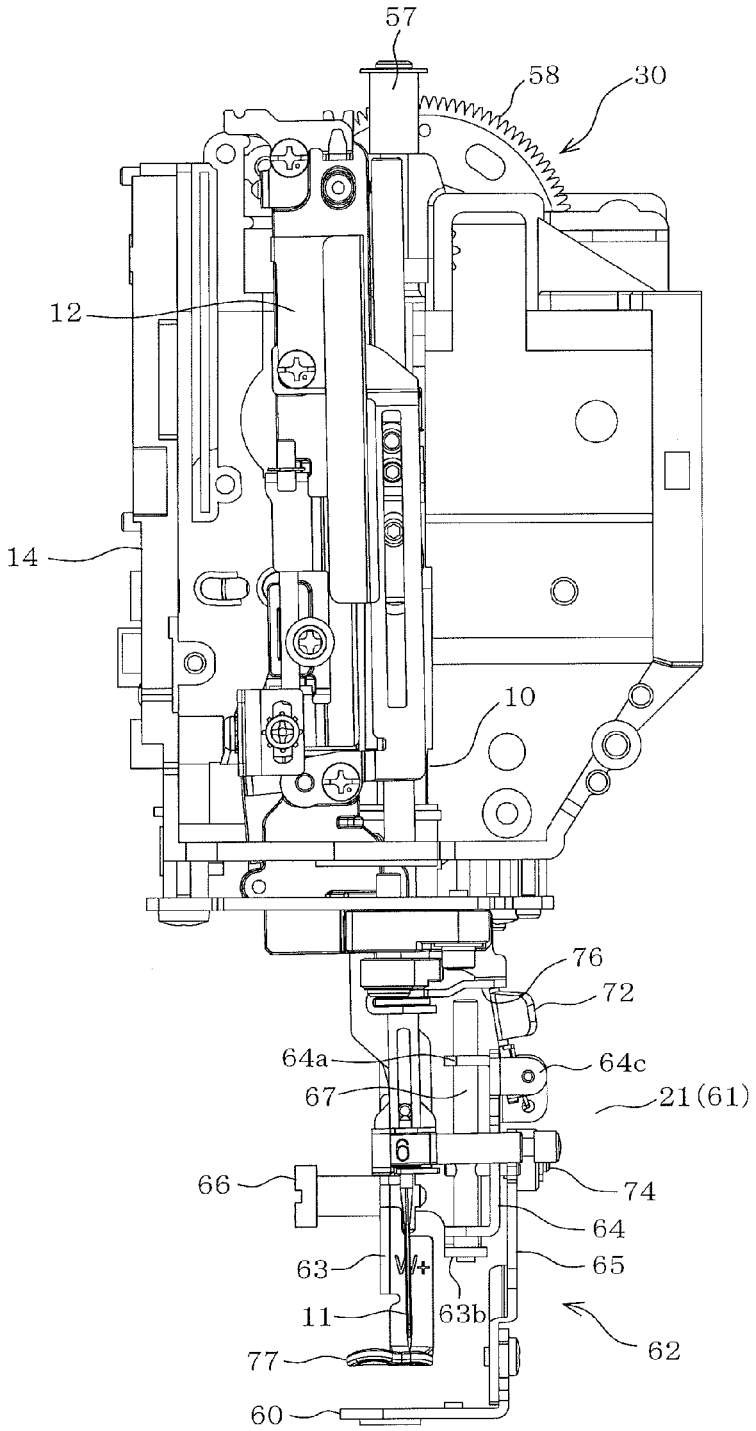
FIG. 10 is a front view of the sewing machine head in the case where the receiving member is located at the working position, showing the inner structure thereof.
Figure 11:
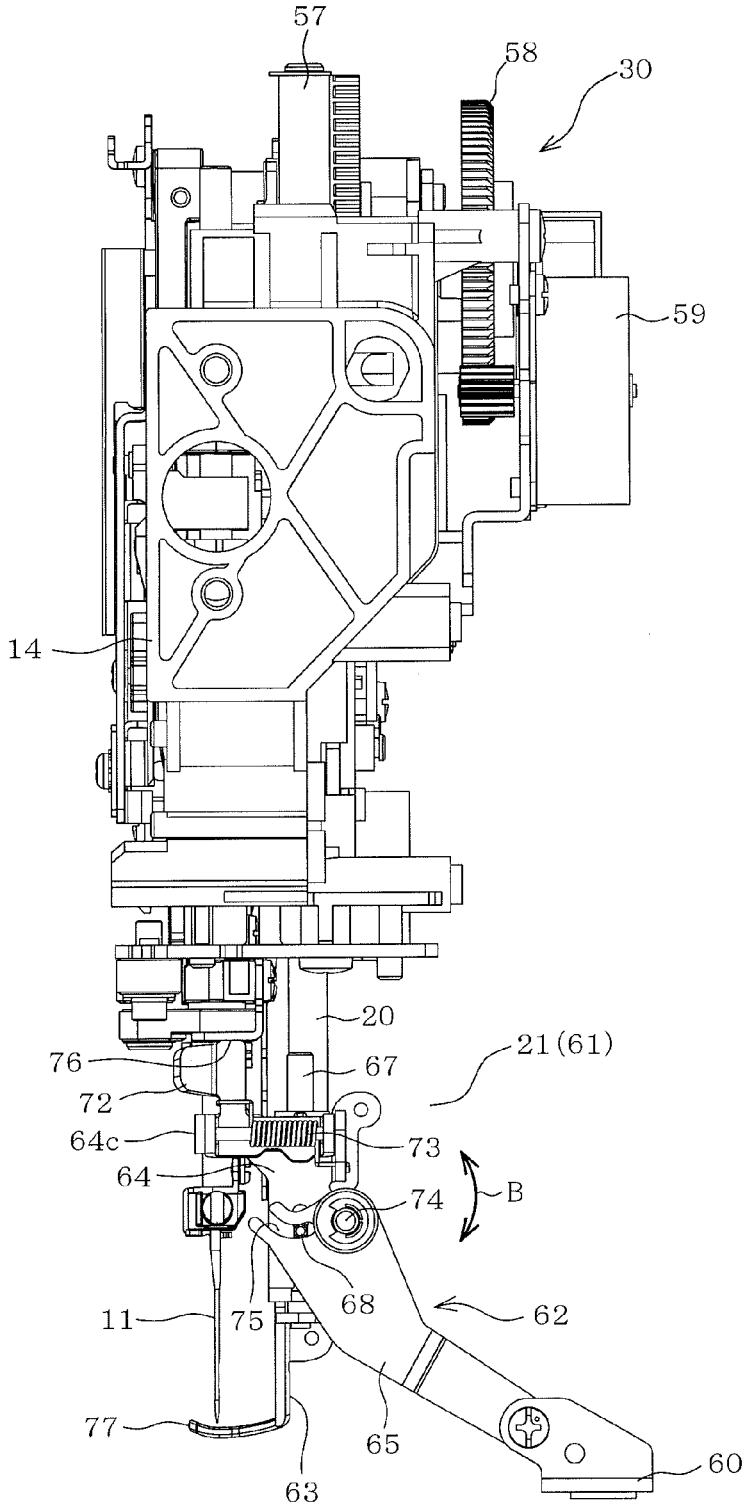
FIG. 11 is a right side view of the sewing machine head in the case where the receiving member is located at the working position, showing the inner structure thereof.

A needle plate 22 is mounted on the top of the bed 2 as shown in FIGS. 6 and 9. The needle plate 22 is provided with a needle hole 22*a* and rectangular holes 22*b* all of which are formed therethrough. The sewing needle 11 is caused to pass through the needle hole 22*a*. A feed dog (not shown) is capable of appearing out of and disappearing into each one of the rectangular holes 22*b*. The needle hole 22*a* formed into an elongate shape, extending in the right-left direction. The sewing needle 11 is passable through the needle hole 22*a* when the needle bar 10 is located at any one of the baseline positions. A feed dog driving mechanism driving the feed dog, a rotating shuttle, a thread cutting mechanism and the like are provided below the needle plate 22 in the bed 2. The rotating shuttle accommodates a bobbin and forms stitches in cooperation with the sewing needle 11. An embroidery machine 23 is detachably attached to a free arm part located on the left of the bed 2. An ordinary sewing table (not shown) may be attached to the free arm part after detachment of the embroidery machine 23. The attachment of the table enlarges a surface on which the workpiece is placed.

The embroidery machine 23 moves an embroidery frame 24 holding the workpiece cloth in the X direction (the right-left direction) and the Y direction (the front-back direction) perpendicular to the X direction. The embroidery machine 23 includes a body 23*a* having a top continuing into the top of the bed 2 and a moving body 25 (see FIG. 1). The moving body 25 is formed into the shape of a thin box long in the front-back direction and is disposed on the body 23*a*. The moving body 25 is movable in the X direction. The moving body 25 has a right side surface on which a carriage 26 is mounted to be movable in the Y direction. The embroidery frame 24 is detachably attached to the carriage 26.

Figure 2:
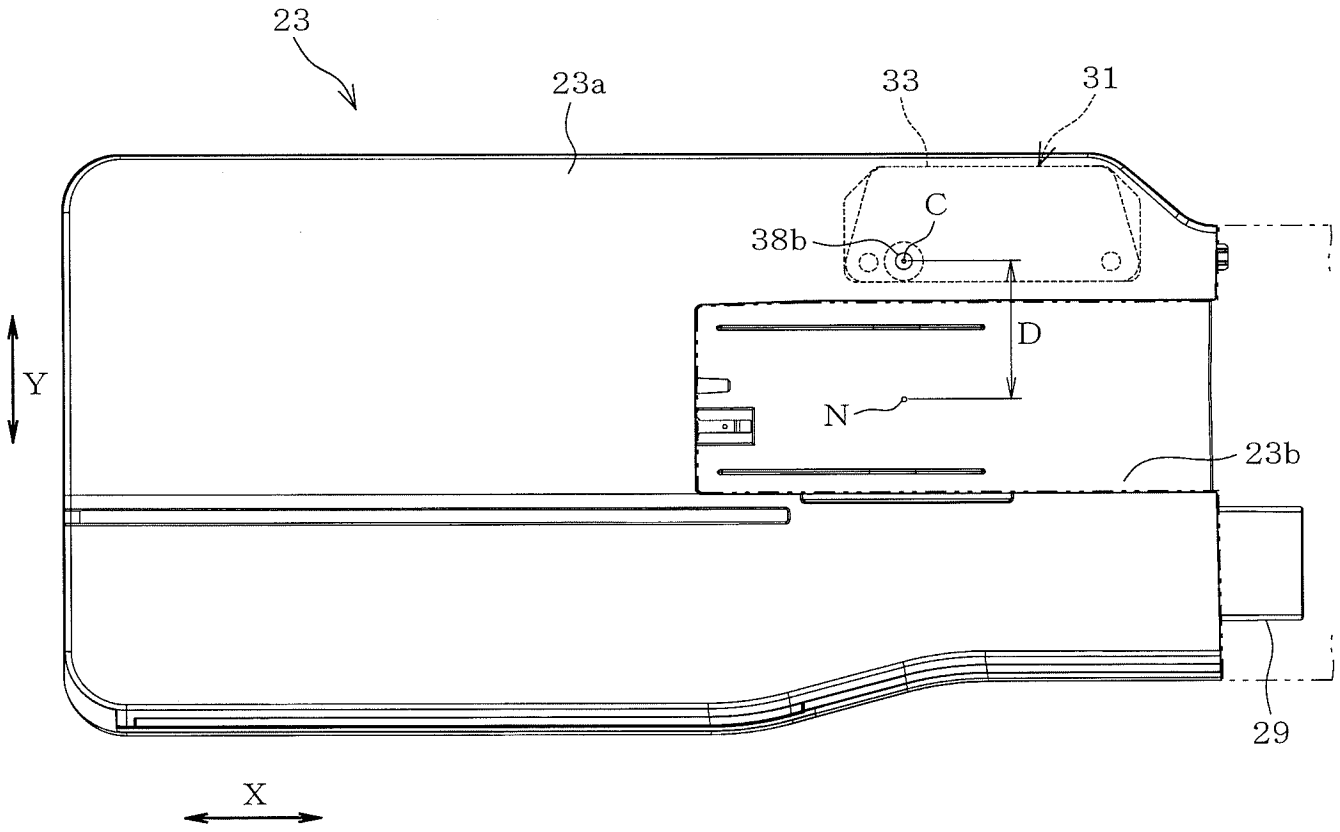
FIG. 2 is a plan view of the embroidering machine with a moving body being eliminated.

An X direction transfer mechanism including an X-axis motor 27 (see FIG. 16) is provided in the body 23*a* although not shown in detail. The X direction transfer mechanism moves the moving body 25 in the X direction. A Y direction transfer mechanism including a Y-axis motor 28 (see FIG. 16) is provided in the moving body 25. The Y direction transfer mechanism moves the carriage 26 in the Y direction. A fitting recess 23*b* is formed to extend rightward from a substantially central part of the body 23*a* as shown in FIG. 2. The free arm part located at the distal end of the bed 2 is fitted into the fitting recess 23*b*. The body 23*a* has a right end formed with a connector 29 which electrically connects the X-axis and Y-axis motors 27 and 28 to the sewing machine 1. More specifically, the connector 29 engages a connector (not shown) at the sewing machine 1 side in association with attachment of the embroidery machine 23 to the bed 2. As a result, the X-axis and Y-axis motors 27 and 28 are electrically connected to a control device 80 of the sewing machine 1. The control device 80 will be described later.

A cutwork device 31 which is unitized is provided on the embroidery machine 23 in order to cut the workpiece cloth, as shown in FIG. 2. The cutwork device 31 is incorporated in a part of the embroidery machine 23 located in the rear of the fitting recess 23*b*. The cutwork device 31 includes a cutting needle 32 forming cuts in the workpiece cloth. A position where a cut is formed in the workpiece cloth by the cutting needle 32 will be referred to as "cutting position C." The cutting position C is spaced a predetermined distance D rearward from the needle location N of the sewing needle 11.

Figure 4:
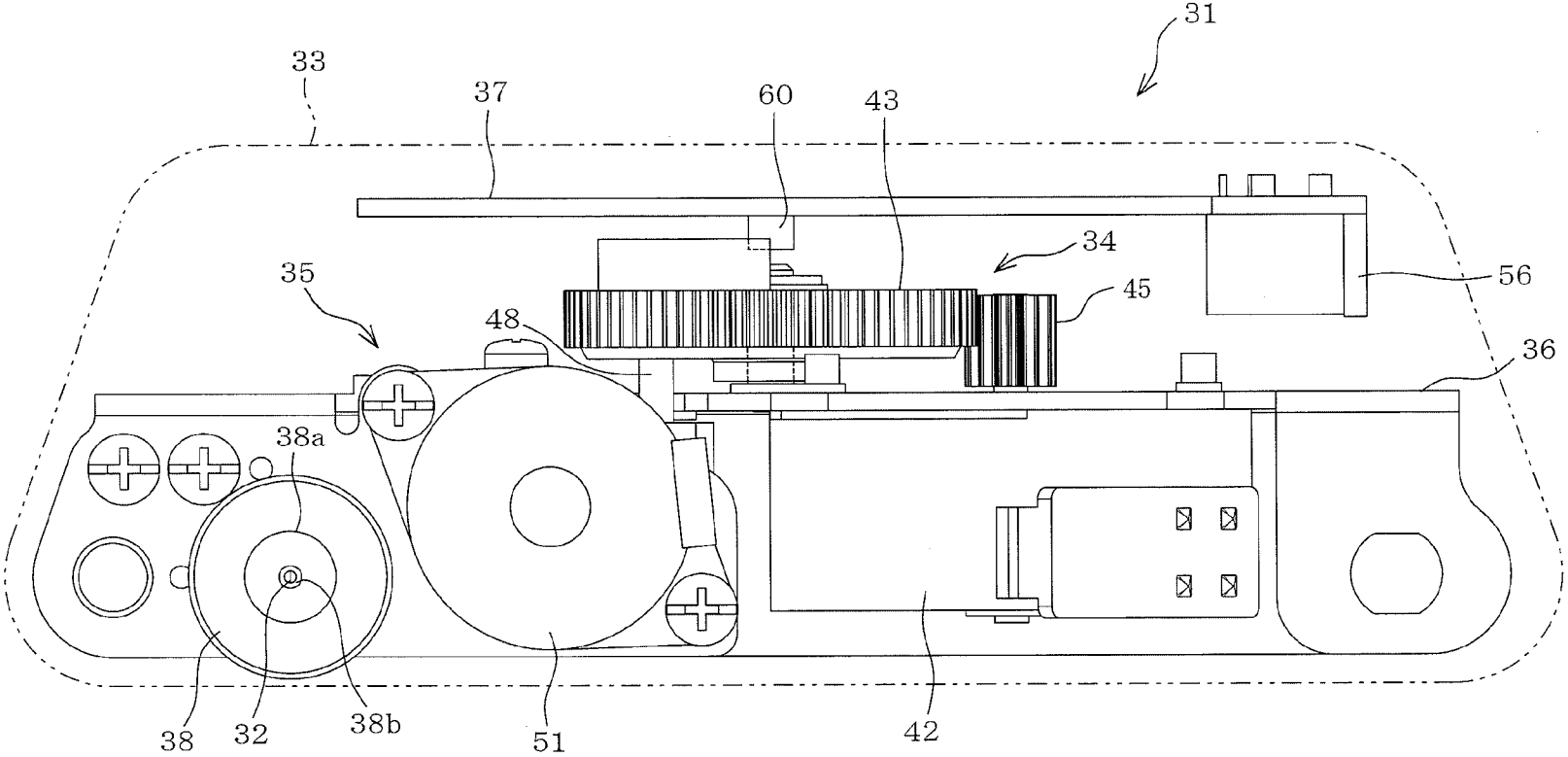
FIG. 4 is an enlarged transversely sectional plan view of the cutwork device, showing an inner structure thereof.
Figure 5:
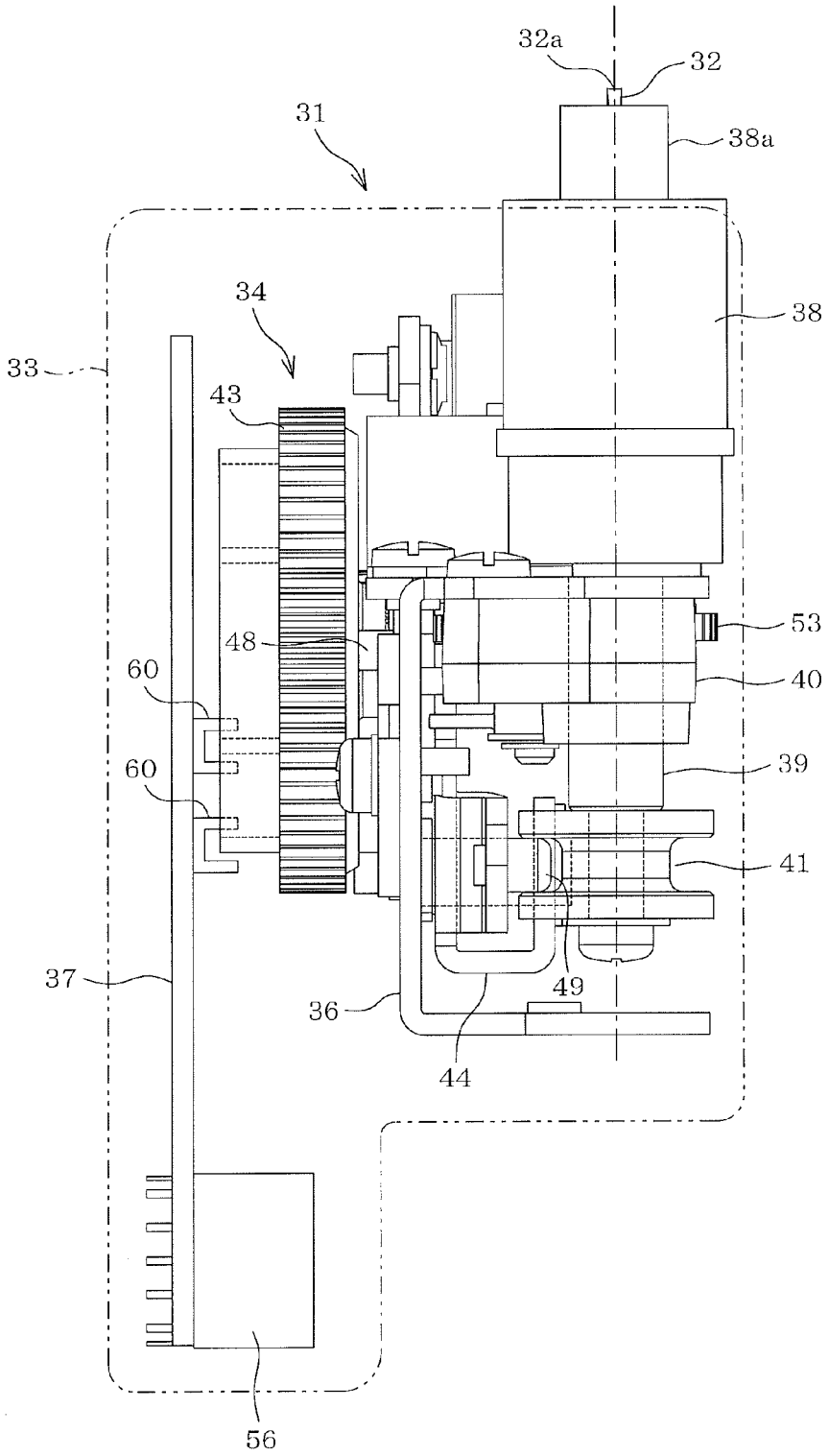
FIG. 5 is an enlarged transversely sectional left side view of the cutwork device, showing the inner structure thereof.

The cutwork device 31 will be described with reference to FIGS. 3 to 5. The needle location N corresponds to a central location in the needle hole 22*a* of the needle plate 22 in the right-left direction. The cutwork device 31 includes a case enclosing the cutting needle 32 having a distal end formed with a blade 32*a*, a cutting needle up-down movement mechanism 34 and a rotating mechanism 35. The up-down movement mechanism 34 moves the cutting needle 32 up and down. The cutting needle 32 is moved above the workpiece cloth from below the workpiece cloth, thereby forming cuts in the workpiece cloth. The rotating mechanism 35 rotates the cutting needle 32 about a vertical axis. The case 33 is formed into a rectangular shape and thin in the front-back direction. The case 33 has a substantially trapezoidal box shape as viewed from the top. Amounting plate 36 and a circuit board 37 are provided in the case 33. Various components are assembled to the mounting plate 36. Electric circuits connected to the respective motors are mounted on the circuit board 37 as will be described later. A needle case 38 for housing the cutting needle 32 is located at an upper front of a left end of the case 33.

The needle case 38 is formed into a cylindrical shape and has an open underside and an upper end having a reduced diameter part 38*a* formed integrally therewith. The reduced diameter part 38*a* has an upper wall formed with a circular hole 38*b* through which a distal end of the cutting needle 32 passes in the up-down direction, as shown in FIG. 6. In the state where the cutwork device 31 is incorporated in the embroidery machine 23, the reduced diameter part 38*a* of the needle case 38 is fitted in a circular hole formed through the top of the body 23*a* of the embroidery machine 23 from below. As a result, an upper surface of the reduced diameter part 38*a* is level with the tops of the body 23*a* and the bed 2. The cutting needle 32 is moved up and down through the hole 38*b*.

Figure 3:
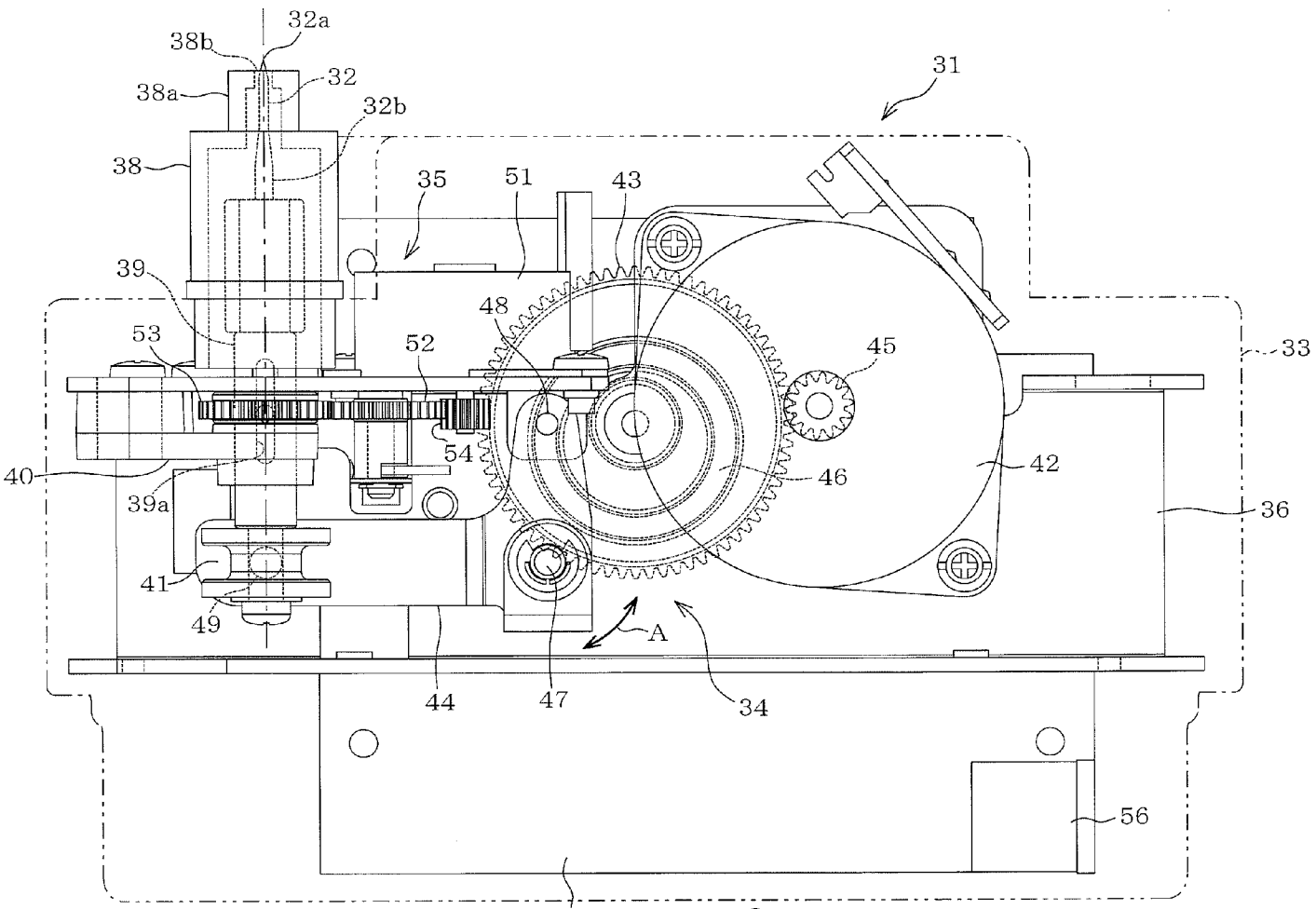
FIG. 3 is an enlarged longitudinally sectional front view of a cutwork device, showing an inner structure thereof.

The cutting needle 32 has a shaft-like grip 32*b* elongate in the up-down direction and a blade 32*a* formed on an upper end of the grip 32*b*, as shown in FIG. 3. The blade 32*a* is shaped so that a blade edge thereof extends substantially linearly in a diametrical direction. The grip 32*b* includes a lower part having a flat surface part formed in a part of an outer periphery thereof, so that the lower part is formed into a D-cut shape. A direction in which the blade edge extends is parallel with the flat surface formed on the grip 32*b*. A support bar 39 is elongate in the up-down direction and includes an upper half covered with the needle case 38. The support bar 39 has an upper end formed with a hole extending in the up-down direction although the hole is not shown in detail. The support bar 39 includes an upper part having an outer periphery formed with a screw hole laterally continuous with the aforesaid hole of the support bar 39. A screw (not shown) engages the screw hole. A lower part of the grip 32*b* is inserted into the hole of the support bar 39. The flat surface part of the grip 32*b* is pressed by the screw thereby to be fixed to the support bar 39. The support bar 39 includes a middle part which extends through the mounting plate 36 in the up-down direction and is supported by a bearing member so as to be rotatable and movable up and down. The support bar 39 has a lower end provided with a connecting part 41 connected to the up-down movement mechanism 34. The support bar 39 includes a middle part formed with an elongate hole 39*a* which is elongate in the up-down direction and is connected to the rotating mechanism 35.

The up-down movement mechanism 34 includes a first motor 42 which is mounted on a right part of the mounting plat 36 so as to be directed rearward, as shown in FIG. 3. A cam gear 43 with a large diameter is rotatably mounted on the mounting plate 36 so as to be located on the left of the first motor 42. A generally L-shaped swing lever 44 is mounted on the mounting plate 36 so as to be located on the left of the cam gear 43. The first motor 42 comprises a stepping motor and has an output shaft to which a driving gear 45 with a small diameter is mounted as shown in FIG. 4. The cam gear 43 is in mesh engagement with the driving gear 45. The cam gear 43 has a front formed with a cam groove 46.

The swing lever 44 is formed into a general L-shape as shown in FIG. 3. The swing lever 44 has a bent portion which is formed in a middle part thereof and supported on a pivot shaft 47 mounted on the mounting plate 36 so as to be swingable in the direction of arrow A. The swing lever 44 includes an upwardly extending part having an end provided with a first engagement pin 48. The first engagement pin 48 is in engagement with the cam groove 46 of the cam gear 43. The swing lever 44 includes a leftwardly extending part having an end provided with a second engagement pin 49. The second engagement pin 49 is in engagement with the connecting part 41 of the support bar 39.

When the cam gear 43 is rotated by the first motor 42 in the construction as described above, the first engagement pin 48 relatively moves in the cam groove 46. The swing lever 44 is then swung in the right-left direction (the direction of arrow A) about the pivot shaft 47. The second engagement pin 49 moves the connecting part 41 up and down by the swing of the swing lever 44 with the result that the cutting needle 32 is moved up and down. The cutting needle 32 is reciprocated between a top dead point and a bottom dead point. The top dead point refers to a position where the blade 32*a* protrudes from the tops of the needle case 38 and the bed 2 through the hole 38*b*. An amount of protrusion of the blade 32*a* is about 5 mm, for example. The bottom dead point refers to a position where the blade 32*a* goes below the hole 38*b*. Two up-down position sensors 50 are provided on the circuit board 37 as shown in FIG. 5. The up-down position sensors 50 detect a rotational position of the cam gear 43. An up-down position of the cutting needle 32 is detected by detection signals generated by the up-down position sensors 50.

The rotating mechanism 35 rotates the cutting needle 32 about an axial center thereby to change the direction of the blade 32*a*. The rotating mechanism 35 includes a second motor 51, a first gear 52 and a second gear 53 as shown in FIG. 3. The second motor 51 is mounted on a left part of the mounting plate 36 so as to be directed downward. The second motor 51 includes an output shaft to which a driving gear 54 with a small diameter is mounted. The first gear 52 is rotatably mounted on the mounting plate 36 so as to be located on the left of the driving gear 54. The first gear 52 is in mesh engagement with the driving gear 54. A rotational position sensor 55 (see FIG. 16) is mounted on the circuit board 37 although not shown in detail. The rotational position sensor 55 detects a rotational position of the first gear 52, that is, a rotation angle of the cutting needle 32.

Upon drive of the second motor 51 in the above-described construction, the second gear 53 is rotated via the first gear 52. Rotation of the second gear 53 further rotates the support bar 39 and the cutting needle 32. As a result, an angle at which the blade 32*a* is directed is changed. The cutwork device 31 includes a connector 56 located at a right lower part of the circuit board 37 as shown in FIGS. 3 and 5. The connector 56 is electrically connected to the control device 80 of the sewing machine 1 in the state where the embroidery machine 23 is attached to the bed 2.

The cutting needle 32 forms cuts in the workpiece cloth when the embroidery machine 23 provided with the above-described cutwork device 31 is attached to the sewing machine 1 and the first and second motors 42 and 51 are driven. In this case, the cutting needle 32 is moved above the workpiece cloth from below the workpiece cloth, thereby forming cuts in the workpiece cloth. In this case, however, the blade 32*a* sometimes pushes the workpiece cloth upward. Cuts are not formed in the workpiece cloth reliably when the workpiece cloth floats. In view of the problem, a catching member 60 is provided to suppress upward floating of the workpiece cloth in the embodiment, as shown in FIGS. 6 to 13.

The catching member 60 is formed into the shape of a slightly horizontally long tongue-like plate as shown in FIG. 6 and the like. The catching member 60 includes a plate face formed with a centrally located insertion hole 60*a* through which the cutting needle 32 is passable in the up-down direction. The catching member 60 is movable between a working position and a retreat position. When located at the working position, the catching member 60 is disposed at the upper surface side of the workpiece cloth located at the cutting position, as shown in FIGS. 9 to 11 and 13. The catching member 60 is retreated upwardly rearward from the working position as shown in FIGS. 6 to 8, 12A and 12B. The catching member 60 is mounted on the presser foot 21, namely, an embroidery presser unit 61. A switching mechanism 62 is provided in order to switch the catching member 60 between the working position and the retreat position by movement of the presser bar 20 by the presser mechanism 20 in the up-down direction.

The catching member 60 is set so that a predetermined slight gap is defined between the catching member 60 and the upper surface of the workpiece cloth when the catching member 60 is located at the working position. More specifically, the catching member 60 is out of contact with the workpiece cloth when located at the working position. As a result, the catching member 60 does not block the movement of the workpiece cloth in the X direction and the Y direction even when located at the working position.

The following will describe in detail the presser foot 21 on which the catching member 60 is mounted, that is, an embroidery presser unit 61 and the peripheral structure thereof with reference to FIGS. 6 to 15C. The embroidery presser unit 61 includes a supporting member 63 having a pressing part 77 as shown in FIGS. 12A, 123, 13A and 13B. A moving member 64 is mounted on the supporting member 63 so as to be movable up and down. A link member 65 is supported on the moving member 64. The link member 65 has a distal end on which the catching member 60 is mounted.

Figure 7:
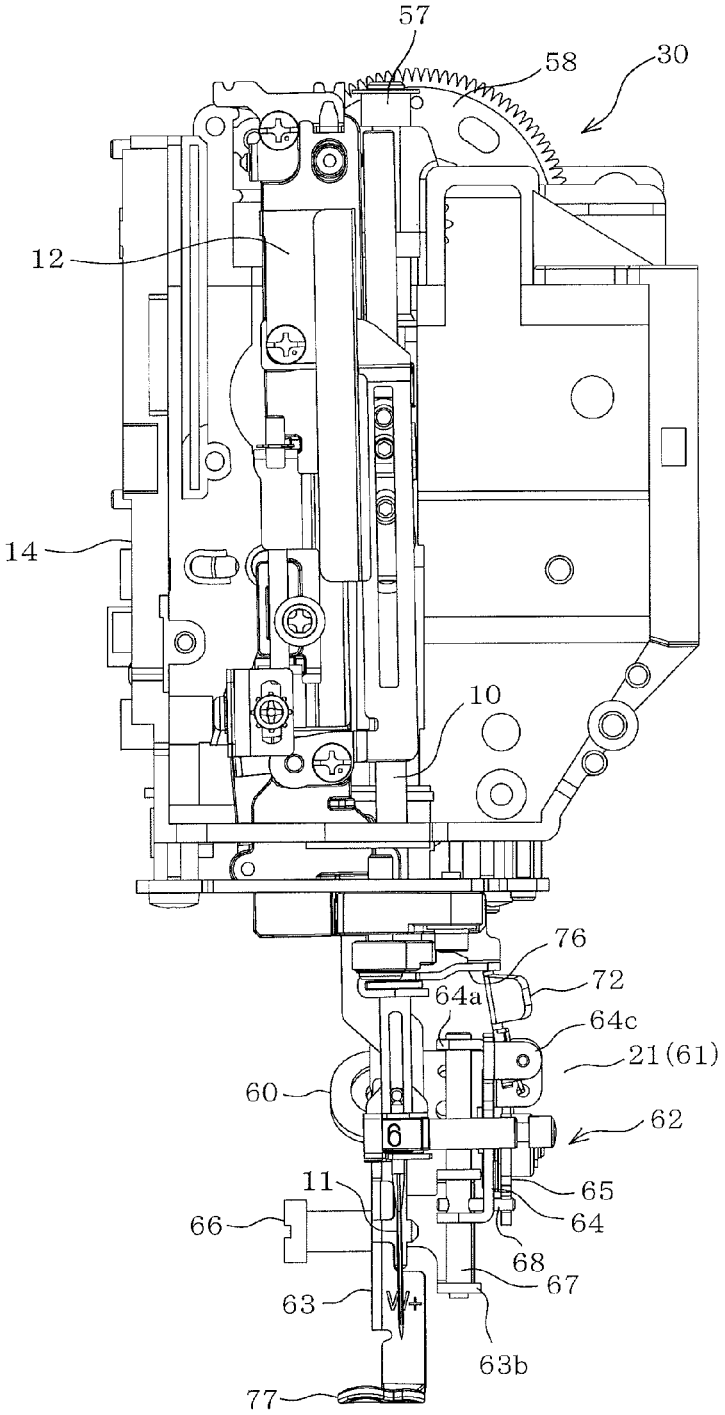
FIG. 7 is a front view of the sewing machine head in the case where the receiving member is located at the retreat position, showing an inner structure thereof.

The pressing part 77 is formed into the shape of a horizontal plate and has a generally keyhole-like needle insertion hole 77*a*, as shown in FIGS. 6, 9 and the like. The pressing part 77 is formed integrally with the supporting member 63 so as to extend forward from a lower end of the supporting member 63. The supporting member 63 has an upper end which is detachably mounted to a lower end of the presser bar 20 by a screw 66 (see FIGS. 7 and 10). The pressing part 77 is disposed to press the upper side of the workpiece cloth held by the embroidery frame 24 when the presser bar 20 is located at the lowered position, as shown in FIGS. 6 to 8.

Figure 12B:
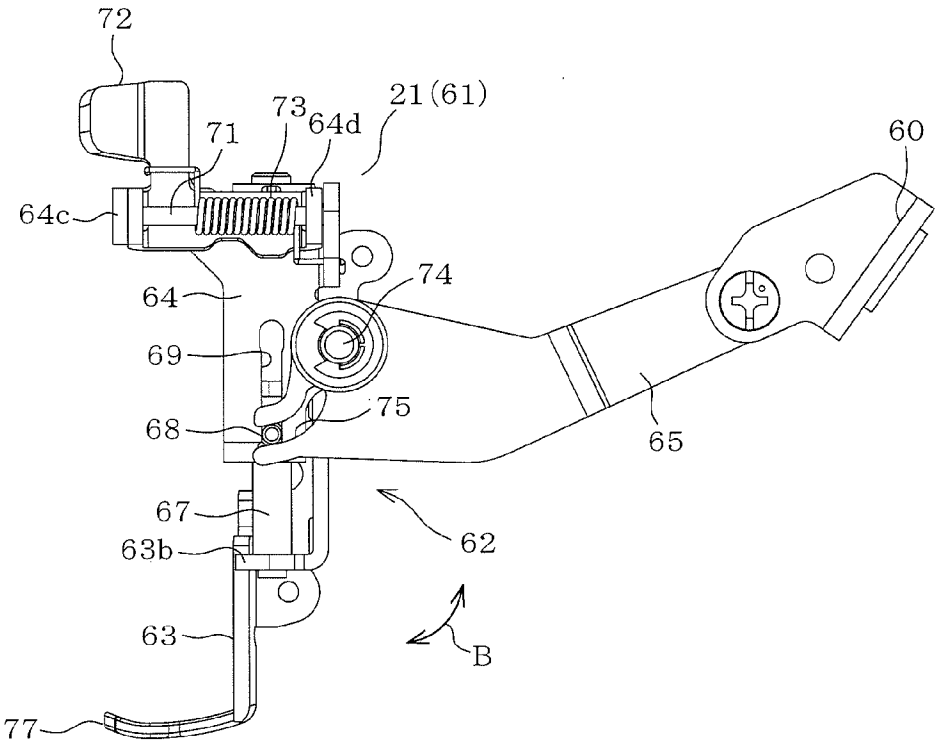
FIGS. 12A and 12B a front view and a right side view of an embroidery presser unit, showing the state where the receiving member is located at the retreat position, respectively.
Figure 12A:
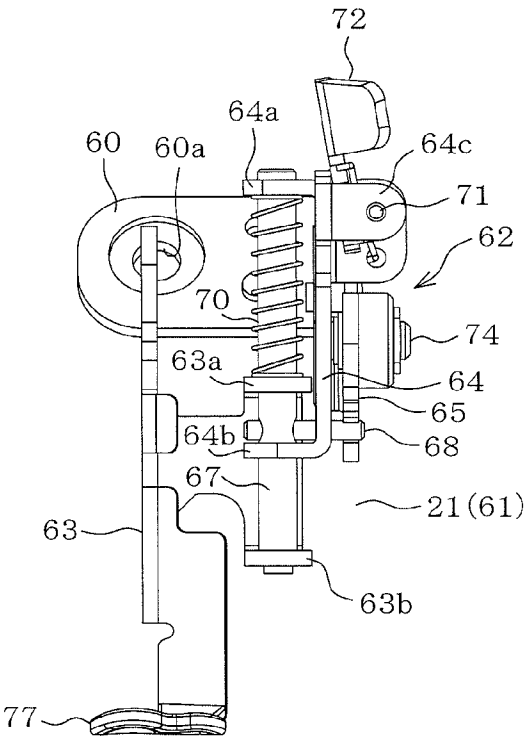
Figure 13B:
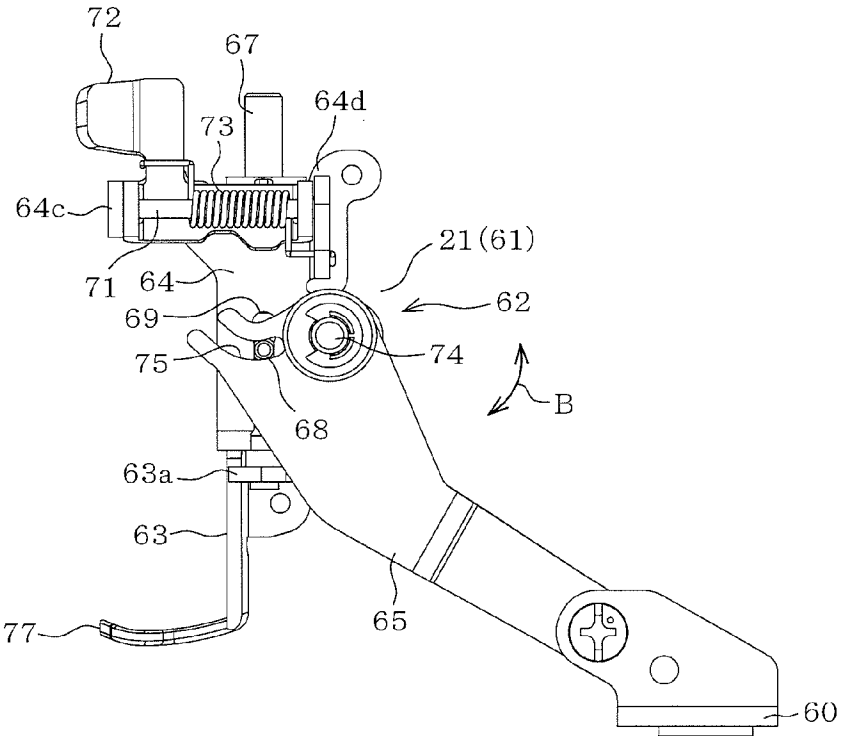
FIGS. 13A and 13B are a front view and a right side view of the embroidery presser unit in the case where the receiving member is located at the working position respectively.
Figure 13A:
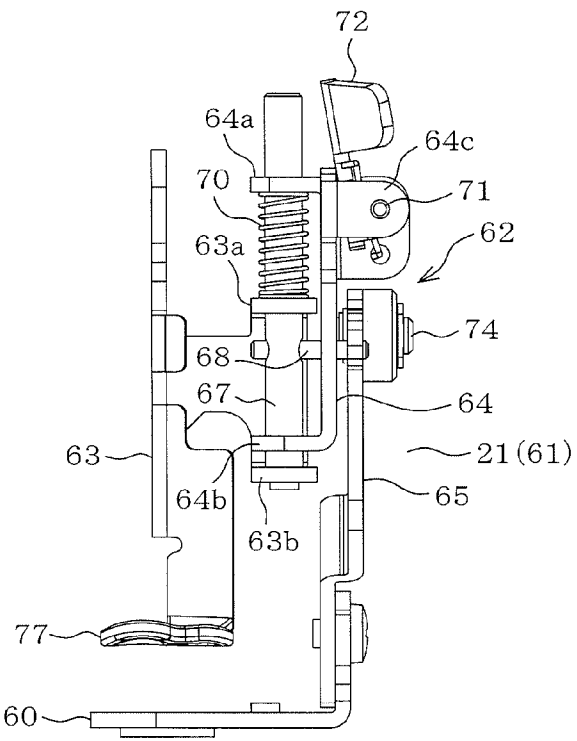

A pair of upper and lower support parts 63*a* and 63*b* protrude forward on a right side of the supporting member 63 as shown in FIGS. 12A, 13A and the like. A support shaft 67 is secured to the support parts 63*a* and 63*b*. The support shaft 67 extends in the up-down direction and has a lower end secured to the lower support part 63*b* and a middle part secured to the upper support part 63*a*. More specifically, an upper part of the support shaft 67 extends above the upper support part 63*a*. An intermediate part of the support shaft 67 includes a portion located slightly lower than the upper support part 63*a*. A pin 68 is inserted in the right-left direction through a hole (not shown) formed through the portion of the support shaft 67, thereby being secured in the hole so as to extend rightward.

The moving member 64 is formed into the shape of a thin plate long in the up-down direction. The moving member 64 has an upper part and a lower part provided with leftwardly protruding guide pieces 64*a* and 64*b* formed integrally therewith, respectively. The guide pieces 64*a* and 64*b* are formed with respective holes through which the support shaft 67 is inserted. The lower guide piece 64*b* is fitted in a part of the support shaft 67 between the pin 68 and the lower support part 63*b*. The upper guide piece 64*a* is fitted in a part of the support shaft 67 located above the support part 63*a*.

The plate surface of the moving member 64 has a slit 69 formed to extend in the up-down direction as shown in FIGS. 12B and 13B. The pin 68 is inserted through the slit 69, further extending in the right-left direction. A compression coil spring 70 surrounds the support shaft 67 between the underside of the upper guide piece 64*a* and the top of the upper support part 63*a*. As a result, the moving member 64 is supported to be movable in the up-down direction while being guided by the support shaft 67. The moving member 64 is normally biased upward relative to the support member 63 by a spring force of the compression coil spring 70 (the state as shown in FIGS. 12A and 12B).

The moving member 64 includes an upper part protruding forward and has front and rear ends further having a pair of shaft support portions 64*c* and 64*d* which are formed integrally with the moving member 64 and protrude rightward, respectively. A horizontal support shaft 71 is mounted between the shaft support portions 64*a* and 64*d* so as to extend in the front-back direction. An abutting member 72 is located at a front side of the horizontal support shaft 71, extending upward. The abutting member 72 is mounted on the horizontal support shaft 71 to be rotatable and axially immovable. More specifically, the abutting member 72 is provided to be swingable at about 30 degrees relative to the horizontal support shaft 71 as viewed from the front. The abutting member 72 is normally biased counterclockwise, namely, rightward by a spring force of a torsion coil spring 73 surrounding the horizontal support shaft 71, as shown in FIG. 12A and the like.

The link member 65 is provided on the right side of the plate surface of the moving member 64 as shown in FIGS. 12B and 13B. The link member 65 is formed into a lever shape and has a proximal end (a left side in FIG. 12B) supported via a pivot shaft 74 on the moving member 64, so that the link member 65 is pivotable in the direction of arrow B. The link member 65 has a cam groove 75 formed in the vicinity of the proximal end into the shape of a slit extending with curvature. The pin 68 has a distal end inserted into the cam groove 75. The catching member 60 is mounted on the distal end of the link member 65 (a right side in FIG. 12B).

As the result of the foregoing construction, when the moving member 64 is subjected to no external force, the spring force of the compression coil spring 70 locates the moving member 64 at a raised position relative to the support member 63, namely, the support shaft 67. More specifically, the moving member 64 is located at a position where the lower guide piece 64*b* is in contact with the pin 68. In this case, the pin 68 is located at an open end side of the cam groove 75, and the link member 65 extends rearward, as shown in FIG. 12B. As a result, the catching member 60 is located at the retreat position as shown in FIGS. 6 to 8.

On the other hand, the moving member 64 is lowered against the spring force of the compression coil spring 70 relative to the support member 63, namely, the support shaft 67. Then, the pin 68 is relatively raised in the slit 69 thereby to be relatively moved toward an inner part of the cam groove 75, as shown in FIGS. 13A and 13B. As a result, the link member 65 is caused to pivot in the direction of arrow B in FIG. 13B, so that the catching member 60 is moved to the working position.

The switching mechanism 62 will now be described. The switching mechanism 62 switches the catching member 60 between the working position and the retreat position. The needle bar base 12 includes a right lower end on which a lock portion 76 is provided as shown in FIGS. 14 to 15C. The lock portion 76 is located above the abutting member 72 when the embroidery presser unit 61, namely, the presser foot 21 is attached to the presser bar 20, as shown in FIGS. 6 to 11. When the needle bar base 12 is located at the first position, namely, when the needle bar 10 is located at the central baseline position or the right baseline position (FIGS. 15A and 15C), the lock portion 76 is located right above the abutting member 72. The lock portion 76 is shifted leftward from right above the abutting member 72 when the needle bar base 12 is located at the second position, namely, when the needle bar 10 is located at the left baseline position (see FIG. 15B).

The embroidery presser unit 61 is moved upward together with the presser bar 20 when the presser bar 20 is moved from the lowered position to the raised position while the needle bar base 12 is at the first position. The moving member 64 is prevented from being further raised when the abutting member 72 abuts against the underside of the lock portion 76. However, the support member 63, namely, the support shaft 67 are further moved upward when the presser bar 20 is further moved upward. On the other hand, the moving member 64 abuts against the lock portion 76 thereby to be stopped. As a result, the moving member 64 is moved downward relative to the support member 63 while the compression coil spring 70 is compressed, as shown in FIGS. 13A and 13B. This relatively raises the pin 68. The catching member 60 is moved to the working position when the presser bar 20 is moved to the raised position, as shown in FIGS. 9 to 11, 13A and 13B.

The support member 63 is moved downward relative to the moving member 64 when the presser bar 20 is gradually moved from the raised position to the lowered position. The moving member 64 is finally moved downward together with the support member 63, so that the abutting member 72 is moved away from the underside of the lock portion 76. This relatively lowers the pin 68 with the result that the catching member 60 is moved to the retreat position as shown in FIGS. 6 to 8, 12A and 12B. The switching mechanism 62 is thus configured to switch the catching member 60 in conjunction with the movement of the moving member 64.

Further, in the case where the needle bar base 12 is located at the second position, the abutting member 72 does not abut against the lock portion 76 even when the presser bar 20 is moved to the raised position. Accordingly, the moving member 64 is maintained at the position shown in FIGS. 12A and 12B at whichever position the presser bar 20 is located, the raised position or the lowered position, in the case where the needle bar base 12 is located at the second position. Accordingly, in this case, the catching member 60 is maintained at the retreat position.

Figure 16:
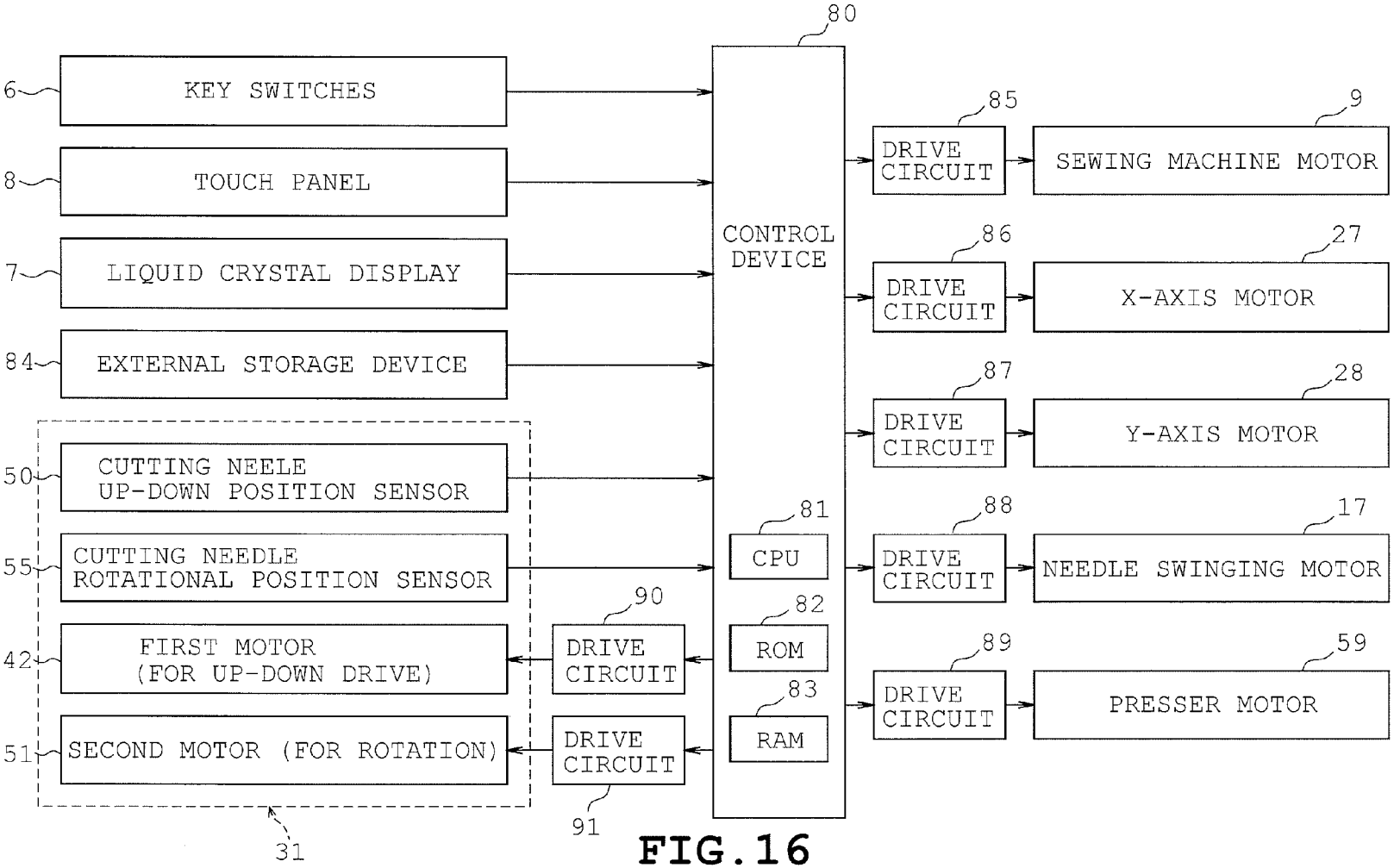
FIG. 16 is a block diagram showing an electrical arrangement of the sewing machine.

The control system of the sewing machine will now be described with reference to the block diagram of FIG. 16. As described above, the control device 80 is provided in the sewing machine 80 to control its entirety. The control device 80 is computer-centric and includes a CPU 81, a ROM 82 and a RAM 83. The ROM 82 stores data of various embroidery data, cutting data and a sewing control program. An external storage device 84 such as a memory card is connected to the control device 80, so that the embroidery data or the cutting data may be read from the external storage device 84.

Operation signals are supplied from the key switches 6 and the touch panel 8 to the control device 80. The control device 80 controls the liquid crystal display 7. The position sensor 50 detects an up-down position of the cutting needle 32 in the cutwork device 31 to generate a detection signal. The detection signal generated by the position sensor 50 is supplied to the control device 80 when the embroidery machine 23 is connected to the sewing machine 1. Further, the rotational position sensor 55 detects a rotational angle of the cutting needle 32 to generate a detection signal. The detection signal generated by the rotational position sensor 55 is supplied to the control device 80. The control device 80 then controls the sewing machine motor 9, the X-axis motor 27, the Y-axis motor 28, the needle swing motor 17 and the presser motor 59 via drive circuits 85, 86, 87, 88 and 89 respectively. The control device 80 further controls the first and second motors 42 and 51 of the cutwork device 31 via drive circuits 90 and 91 respectively.

As a result, the control device 80 controls the sewing machine motor 9, the X-axis motor 27 and the Y-axis motor 28 of the embroidery machine 23 and the like based on the embroidery data, so that an embroidery sewing operation is automatically performed for the workpiece cloth. The control device 80 further controls the first and second motors 42 and 51 of the cutwork device 31 based on the cutting data. With this, the control device 80 controls the X-axis and Y-axis motors 27 and 28 of the embroidery machine 23 so that a cutting operation is automatically performed for the workpiece cloth. In this case, the control device 80 controls the needle swing motor 17 thereby to control the right-left position of the needle bar base 12, namely, the baseline position of the needle bar 10. More specifically, in execution of the embroidery sewing operation, the control device 80 controls so that the needle bar base 12 is located at the second position, namely, so that the needle bar 10 is located at the left baseline position. For example, the catching member 60 is maintained at the retreat position even when the embroidery sewing is interrupted or stopped and the presser foot is moved up and down by the presser mechanism 30. On the other hand, in execution of the cutting operation by the cutwork device 31, the control device 80 controls so that the needle bar base 12 is located at the first position, for example, so that the needle bar 10 is located at the central baseline position. The presser foot 21 is moved to the raised position by the presser mechanism 30, so that the catching member 60 is located at the working position. In this state, the cutting operation is executed by the cutwork device 31.

Advantageous effects achieved by the foregoing sewing machine 1 will now be described. In the embodiment, the cutwork device 31 forming cuts in the workpiece cloth is provided on the embroidery machine 23 attached to the bed 2 part separately from mechanisms for the sewing operation. As a result, the cutwork device 31 suitable for cutting the workpiece cloth can be provided. The head 5 can be prevented from increasing the size of the entire sewing machine 1.

The cutwork device 31 forms cuts in the workpiece cloth while pushing the workpiece cloth upward from below. Accordingly, the workpiece cloth would float with the result that there would be a case where no cuts are formed in the workpiece cloth. In the embodiment, however, the catching member 60 is provided. Consequently, the upward floating of the workpiece cloth can be suppressed during the operation of the cutwork device 31. More specifically, the cuts can reliably be formed in the workpiece cloth without increase in the size of the sewing machine while the floating of the workpiece cloth is suppressed during the cutting operation.

The catching member 60 is disposed at the cutting position C on the upper surface side of the workpiece cloth. The catching member 60 has the insertion hole 60*a* through which the cutting needle 43 is insertable in the up-down direction. Accordingly, the catching member 60 is prevented from being brought into contact with the cutting needle 32 during the operation of the cutwork device 31, so that the upward floating of the workpiece cloth can be prevented.

The switching mechanism 62 is provided for switching the catching member 60 between the working position where the catching member 60 is disposed at the cutting position C on the upper surface side of the workpiece cloth and the retreat position where the catching member 60 is retreated upward from the working position. As a result, the catching member 60 can be located at the working position during use of the cutwork device 31, whereas the catching member 60 can be located at the retreat position in the embroidery sewing which does not require the use of the cutwork device 31. As a result, the catching member 60 does not hinder the embroidery sewing.

The switching mechanism 62 is configured so that the position of the catching member 60 is switched by the presser mechanism 30 up-down moving the presser bar 20 having the lower end to which the presser bar 21 is attached. Thus, the catching mechanism 60 can be realized by a relatively simple configuration.

Further, the switching mechanism 62 switches the position of the catching member 60 in conjunction with the movement of the moving member 64 moving up and down. The presser bar 20 is moved to the raised position by the presser mechanism 30 while the needle bar base 12 is located at the first position within the swing range. The abutting member 72 of the moving member 64 then abuts against the lock portion 76 of the needle bar base 12, so that the presser bar 20 is relatively moved, with the result that the catching member 60 is moved to the working position.

Further, the switching mechanism 62 moves the catching member 60 to the retreat position when the presser bar 20 is moved to the lowered position. Thus, the catching member 60 can be moved to the working position or the retreat position in conjunction with the presser bar 20 using the needle bar base 12 when the needle bar base 12 is located at the first position within the swing range.

The switching mechanism 62 and the catching member 60 are assembled integrally to the embroidery-sewing presser foot 21 into the embroidery presser unit 61. Accordingly, the workpiece cloth can be cut by the cutwork device 31 in the state where the embroidery-sewing presser foot 21 is attached to the presser bar 20. An ordinary sewing presser foot is provided with no switching mechanism 62 nor catching member 60. Accordingly, the switching mechanism 62 and the catching member 60 do not hinder the sewing work during execution of the ordinary sewing operation.

In the case where the needle bar base 12 is located at the second position differing from the first position, the abutting member 72 of the moving member 64 does not abut against the locked portion 76 of the needle bar base 12 even when the presser bar 20 is moved to the raised position by the presser mechanism 30. In this case, the catching member 60 is maintained at the retreat position. As a result, the catching member 60 can reliably be prevented from being wrongly moved to the working position while the needle bar base 12 is located at the second position, namely, while an embroidery sewing operation is in execution.

The cutwork device 31 is provided on the embroidery sewing machine 23 in the foregoing embodiment. However, the cutwork device may be provided on the sewing machine or an ordinary sewing table attached to the bed. Various changes are possible in the specific construction of the cutwork device 31. For example, components of the cutwork device 31 may directly be assembled into the bed 2 without provision of the case 33.

In the foregoing embodiment, the switching mechanism 62 switching the catching member 60 between the working position and the retreat position is configured to be operated in conjunction with the up-down movement of the presser bar 20. However, the catching member 60 may independently be switchable between the working position and the retreat position irrespective of the up-down movement of the presser bar 20. The catching member 60 need not be provided integrally on the presser foot 21 as the embroidery presser unit 61 even when position switch is carried out in conjunction with the presser bar 20. The catching member 60 and the switching mechanism 62 may be incorporated separately from the presser foot 21. The switching mechanism may be configured to be automatically switchable.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

We claim:

1. A sewing machine comprising:

a sewing machine head including a needle bar to which a sewing needle is attachable;

a presser bar provided on the sewing machine head and having a lower end to which a presser foot configured to press a workpiece cloth is attachable;

a presser mechanism provided in the sewing machine head and configured to move the presser bar between a raised position and a lowered position;

a sewing machine bed having an upper surface on which the workpiece cloth is placed so that sewing may be performed on the workpiece cloth;

a cutwork device provided on the sewing machine bed and including a cutting needle with a distal end having a blade and a cutting needle up-down movement mechanism moving the cutting needle up and down, the cutwork device being configured to form a cut in the workpiece cloth by the cutting needle at a cutting position from below the workpiece cloth, the cutting position being spaced a predetermined distance rearward from a needle location of the sewing needle on the sewing machine bed;

a catching member configured to suppress upward floating of the workpiece cloth caused by the cutting needle during operation of the cutwork device; and a switching mechanism configured to switch the catching member between: (i) a working position where the catching member is disposed at the cutting position at the side of the upper surface of the workpiece cloth, and a retreat position retreated upwards from the working position, thereby switching a position of the catching member by a movement of the presser bar by the presser mechanism.

2. The sewing machine according to claim 1, wherein the catching member is disposed at the cutting position at a side of an upper surface of the workpiece cloth and has an insertion part through which the cutting needle is insertable in an up-down direction.

3. The sewing machine according to claim 1, wherein:

the sewing machine head is provided with a needle bar base configured to support the needle bar so that the needle bar is movable up and down and a swinging mechanism configured to swing the needle bar base in a right-left direction together with the needle bar, the switching mechanism has a moving member configured to move in the up-down direction and is configured to switch the position of the catching member in conjunction with movement of the moving member, when the presser bar is moved to the raised position by the presser mechanism in a case where the needle bar base is located at a first position within a swing range, the moving member is configured to abut against the needle bar base to be moved downward relative to the presser bar thereby to move the catching member to the working position, and when the presser bar is moved to the lowered position by the presser mechanism, the moving member is configured to be moved away from the needle bar base thereby to move the catching member to the retreat position.

4. The sewing machine according to claim 1, wherein the presser foot is intended for use in embroidery sewing, and the switching mechanism and the catching member are provided on the presser foot for the use in embroidery sewing.

5. The sewing machine according to claim 3, wherein in a case where the needle bar base is located at a second position differing from the first position, the catching member is located at the retreat position without abutment of the moving member against the needle bar even when the presser bar is moved to the raised position by the presser mechanism.

* * * * *